US006334636B1

(12) United States Patent
Huang et al.

(10) Patent No.: US 6,334,636 B1
(45) Date of Patent: Jan. 1, 2002

(54) REMOTELY CONTROLLABLE LOCK

(75) Inventors: Chao-Ming Huang; Chih-Cheng Huang; Jo-Chiao Wang, all of Kaohsiung Hsien (TW)

(73) Assignee: Taiwan Fu Hsing Industrial Co., Ltd., Kaohshiung Hsien (TW)

( * ) Notice: Subject to any disclaimer, the term of this patent is extended or adjusted under 35 U.S.C. 154(b) by 10 days.

(21) Appl. No.: 09/635,356

(22) Filed: Aug. 9, 2000

(51) Int. Cl.[7] ..... E05C 1/06

(52) U.S. Cl. ..... 292/144; 292/142; 292/138; 292/199; 292/201; 292/280; 292/279; 292/DIG. 25; 292/DIG. 53; 292/341.16; 292/336.3; 292/22; 70/277; 70/275

(58) Field of Search ..... 292/144, 138, 292/142, 199, 22, 201, 280, 279, DIG. 23, DIG. 25, DIG. 53, 341.16, 336.3; 70/277, 275

(56) References Cited

U.S. PATENT DOCUMENTS

| | | | | | |
|---|---|---|---|---|---|
| 3,733,861 | A | * | 5/1973 | Lester | 70/277 |
| 4,843,851 | A | * | 7/1989 | Frolov | 70/277 |
| 5,199,288 | A | * | 4/1993 | Meriläinen et al. | 70/279 |
| 5,472,065 | A | * | 12/1995 | Vergin | 185/40 R |
| 5,790,034 | A | * | 8/1998 | Khoury | 340/574 |
| 5,857,365 | A | * | 1/1999 | Armstrong | 70/279 |
| 6,012,310 | A | * | 1/2000 | Hsiao | 70/278.2 |
| 6,062,612 | A | * | 5/2000 | Lin | 292/144 |
| 6,076,383 | A | * | 6/2000 | Clark et al. | 70/189 |
| 6,112,563 | A | * | 9/2000 | Ramos | 70/278.1 |

* cited by examiner

*Primary Examiner*—B. Dayoan
*Assistant Examiner*—Carlos Lugo
(74) *Attorney, Agent, or Firm*—Bacon & Thomas

(57) ABSTRACT

A remotely controllable lock includes a turn knob rotatably mounted to a main housing. The turn knob includes an axle rod with a non-circular hole through which a spindle of the lock extends. A power element is mounted in the main housing for driving a relatively larger gear of a power device. The relatively larger gear and a relatively smaller gear are integrally formed on a common shaft that has two ends to which two slide blocks are pivotally mounted, respectively. The slide blocks are mounted in a receiving hole in the main housing and a receiving hole in a fixing plate. The slide blocks are biased by elastic elements. One of the slide blocks includes a stub that extends beyond the associated receiving hole to come in contact with a sensor. The sensor sends out a signal to stop the power element. The relatively smaller gear meshes with a control gear of a control device. The control gear is rotatably mounted around the axle rod of the turn knob. The control gear comprises a positioning block and an eccentric actuating block. When the control gear rotates, the actuating block comes in contact with one of an upper pressing block and a lower pressing block of a movable plate so as to make the positioning block come in contact with a sensor to send out a signal for stopping the power element. The movable plate includes a rack that meshes with a sector-toothed gear which, in turn, is mounted around a non-circular portion of the axle rod to rotate therewith. The movable plate includes a pressing rod that is capable of coming in contact with a switch for sending out a signal to control execution of driving of the power element. The fixing plate is mounted to the main housing by fasteners and includes an axle hole for rotatably supporting the axle rod to thereby retract/extend the dead bolt by a spindle.

8 Claims, 7 Drawing Sheets

REMOTELY CONTROLLABLE LOCK

BACKGROUND OF THE INVENTION

1. Field of the Invention

The present invention relates to a remotely controllable lock that may be operated by either a manual mode or a remote-control mode for controlling extension/retraction of the latch bolt to thereby close/open the door.

2. Description of the Related Art

U.S. Pat. No. 5,447,047 to Lin issued on Sep. 5, 1995 discloses a dead bolt including an outer lever and an inner lever, a coil disposed in the outer sleeve, a rod slidably engaged in the coil and having two extensions, a shaft coupled between the two levers, and a disc engaged on the shaft and having two grooves for engaging with the extensions of the rod. The extensions of the rod are biased away from the grooves of the disc such that the shaft cannot be rotated by the outer lever, and the rod is caused to move toward the disc when the coil is energized such that the extensions of the rod are caused to engage with the grooves of the disc and such that the shaft can be rotated by the outer lever. Such a structure is complicated. In addition, unlocking from outside is troublesome as the extensions of the rod must be pushed to engage with the grooves of the disc within the energizing time that awaits input of signal.

U.S. Pat. No. 6,062,612 to Lin issued on May 16, 2000 discloses a remotely controllable lock including a housing, a motor mounted in the housing, and a control device mounted in the housing for activating the motor. A gear train is mounted in the housing and driven by an output shaft of the motor and has a drive gear. A turn knob has an axle rod extended through an axle tube mounted to the housing. The axle rod is engaged with a driving member for driving a dead bolt of the door lock. When the turn knob is manually turned through a pre-determined angle, the movable plate is moved from a first position representing one of a locked status and an unlocked status of the dead bolt to a second position representing the other one of the locked status and the unlocked status without actuating the drive gear. When the control means receives a signal from remote control that requests a change in the status of the dead bolt, the movable plate is moved by the drive gear from one of the first position and the second position to the other of the first position and the second position, and the turn knob is turned through the pre-determined angle.

The present invention is intended to provide a remotely controllable lock that may be operated by either a manual mode or a remote-control mode.

SUMMARY OF THE INVENTION

It is an object of the present invention to provide a remotely controllable lock that may be operated by either a manual mode or a remote-control mode for controlling extension/retraction of the latch bolt to thereby close/open the door.

It is another object of the present invention to provide a remotely controllable lock that includes a protective mechanism for immediately stopping motions when under an external or abnormal resistance, thereby preventing damage to the lock.

It is a further object of the present invention to provide a remotely controllable lock that can be easily converted for use with either a right-handed door or a left-handed door.

A remotely controllable lock in accordance with the present invention comprises:

a main housing comprising a power element mounted therein, the power element being operably controlled via a wire control unit, the power element including a transmission element for outputting power, the main housing further including a turn knob rotatably mounted thereto, the turn knob comprising an axle rod with a non-circular hole through which a spindle of the remotely controllable lock extends, the main housing including a first receiving hole, the axle rod further including a non-circular portion on an outer periphery thereof;

a power device comprising two slide block, a shaft including two ends pivotally connected to the slide blocks, respectively, the shaft further including a relatively larger gear and a relatively smaller gear mounted thereon, the relatively larger gear meshing with the transmission element;

a control device comprising a control gear that is rotatably mounted to the axle rod of the turnknob, the control gear meshing with the relatively smaller gear of the power device, the control gear comprising a positioning block and an eccentric actuating block, the control device further including a movable plate that has a vertical slot for receiving the axle rod, thereby allowing the movable plate to be movable along a vertical axis of the axle rod, the movable plate including a rack, a sector-toothed gear being mounted around the non-circular portion of the axle rod to rotate therewith, the sector-toothed gear meshing with the rack, the movable plate further including a pressing rod that is capable of coming in contact with a switch; and a fixing plate secured to the main housing and comprising a second receiving hole, one of the slide blocks being received in the first receiving hole of the main housing and the other of the slide blocks being received in the second receiving hole of the fixing plate, each said slide block being biased by an elastic element, one of the slide blocks including a stub extended beyond an associated one of the first receiving hole and the second receiving hole, the stub being capable of coming in contact with a first sensor to send out a signal for stopping the power element, the fixing plate further including an axle hole for rotatably supporting the axle rod and through which the spindle extends for driving a dead bolt of the remotely controllable lock;

whereby when the control gear rotates, the actuating block comes in contact with one of the upper pressing block and the lower pressing block of the movable plate so as to make the positioning block come in contact with a second sensor to send out a signal for stopping the power element.

Other objects, specific advantages, and novel features of the invention will become more apparent from the following detailed description and preferable embodiments when taken in conjunction with the accompanying drawings.

DETAILED DESCRIPTION OF THE PREFERRED EMBODIMENTS

Preferred embodiments in accordance with the present invention will now be described with reference to the accompanying drawings.

Figure 1:
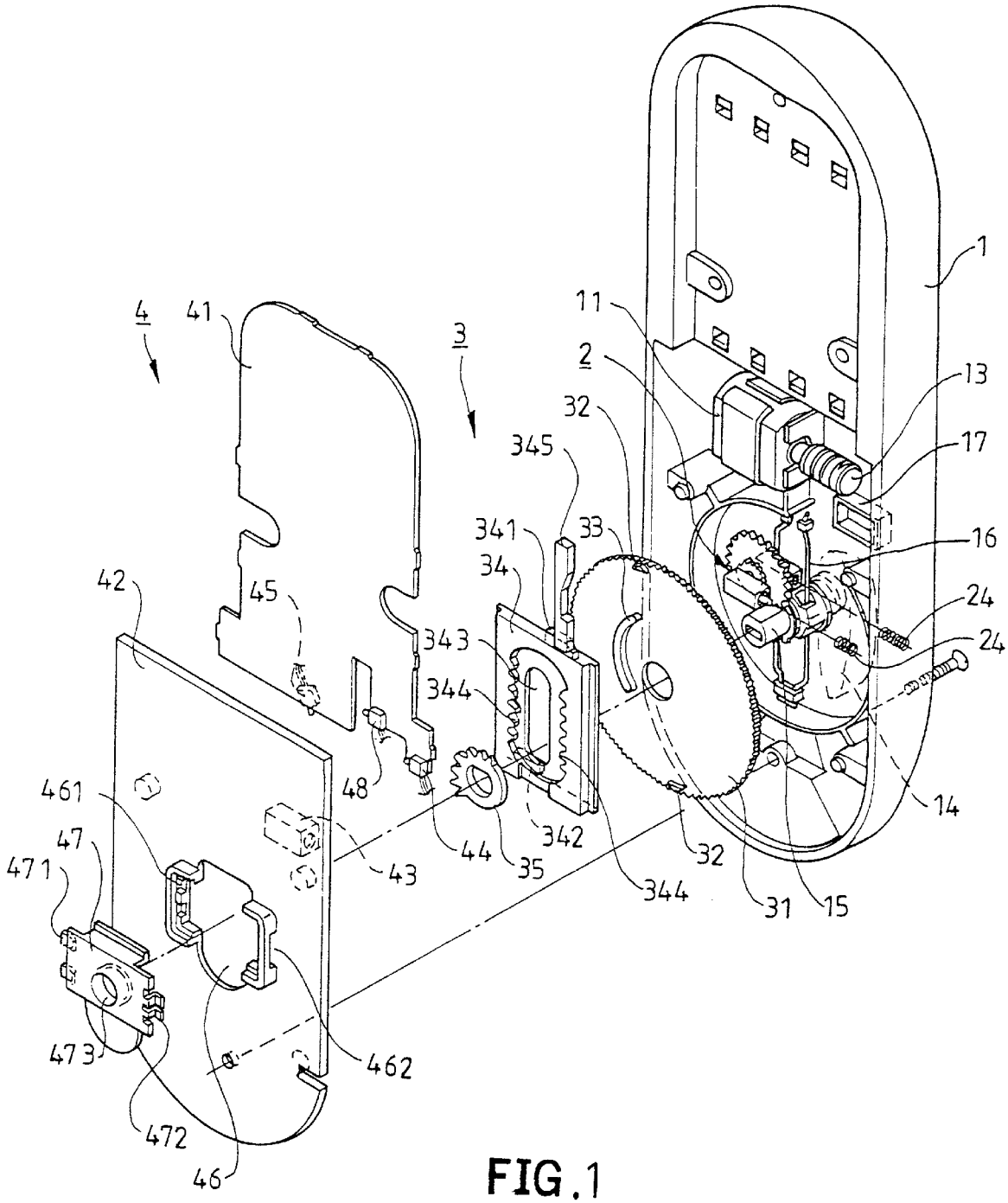
FIG. 1 is an exploded perspective view of a remotely controllable lock in accordance with the present invention.
Figure 2:
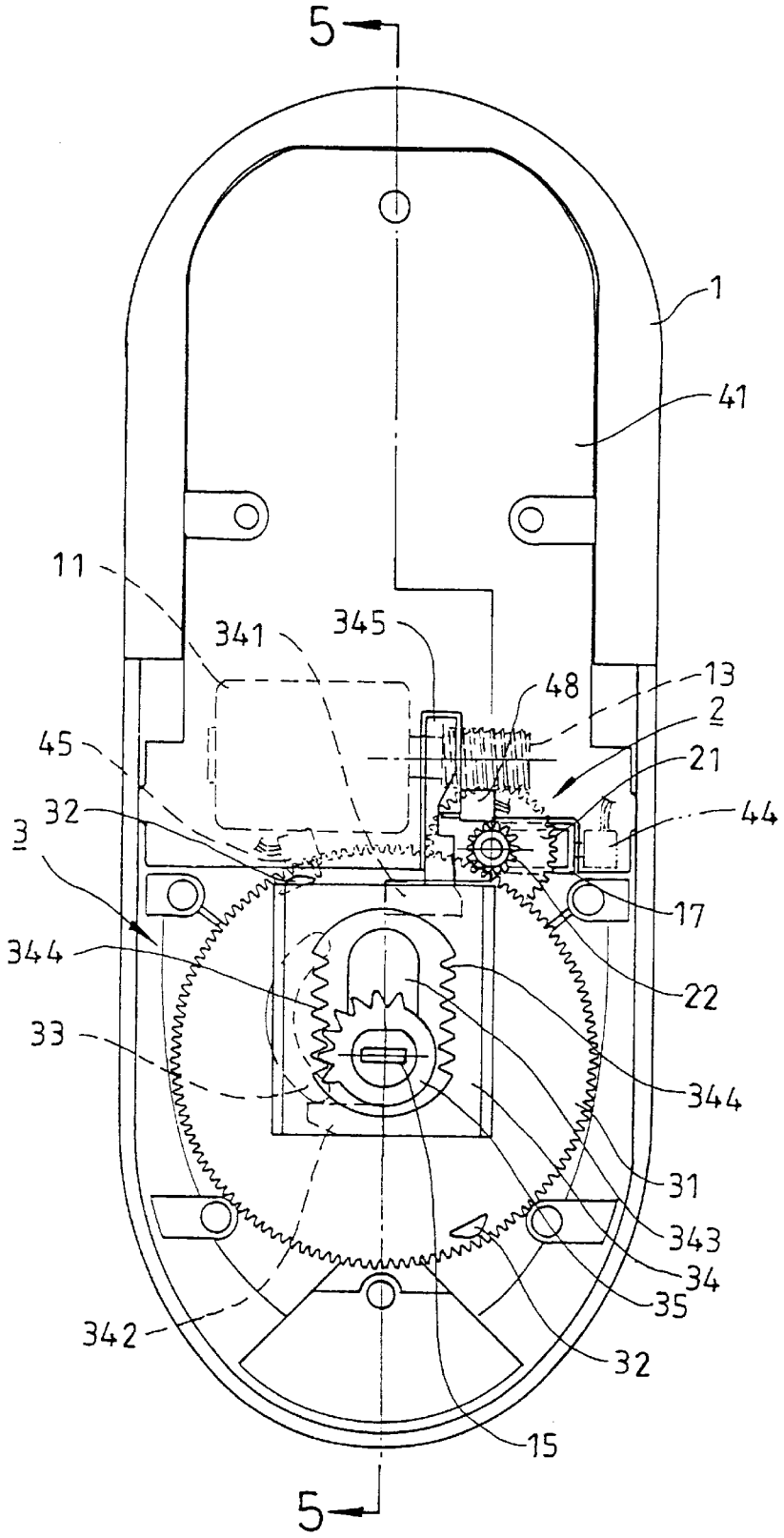
FIG. 2 is an elevational view of the remotely controllable lock in accordance with the present invention.

Referring to FIGS. 1 and 2, a remotely controllable lock in accordance with the present invention generally includes a main housing 1, a power device 2, a control device 3, and a fixing device 4. The main housing 1 is mounted to an inner side of a doorplate (not shown) and receives a power element 11 (such as a motor) that can be driven by either alternating or direct current. The power element 11 is controlled via a wire control unit comprising circuits and elements that are directly mounted on an upper fixing plate 41 of the fixing device 4. The wire control unit includes conventional signal receivers, signal transmitters, etc. The wire control unit activates the power element 11 upon reception of a control signal from a remote control to thereby actuate the power device 2 and the control device 3 for extending or retracting the dead bolt (not shown) for latching/unlatching purpose, which is conventional and therefore not described in detail. A turn knob 14 is mounted to the main housing 1 and located at the inner side of the door for manual operation. The turn knob 14 includes an axle rod 15 that may directly drives a spindle (not shown) of the lock to thereby extend/retract the dead bolt. In addition, the axle rod 15 includes a non-circular portion on an outer periphery thereof that is clamped by an elastic element 16 for retaining the turn knob 14 in predetermined positions after the turn knob 14 has been rotated.

Figure 5:
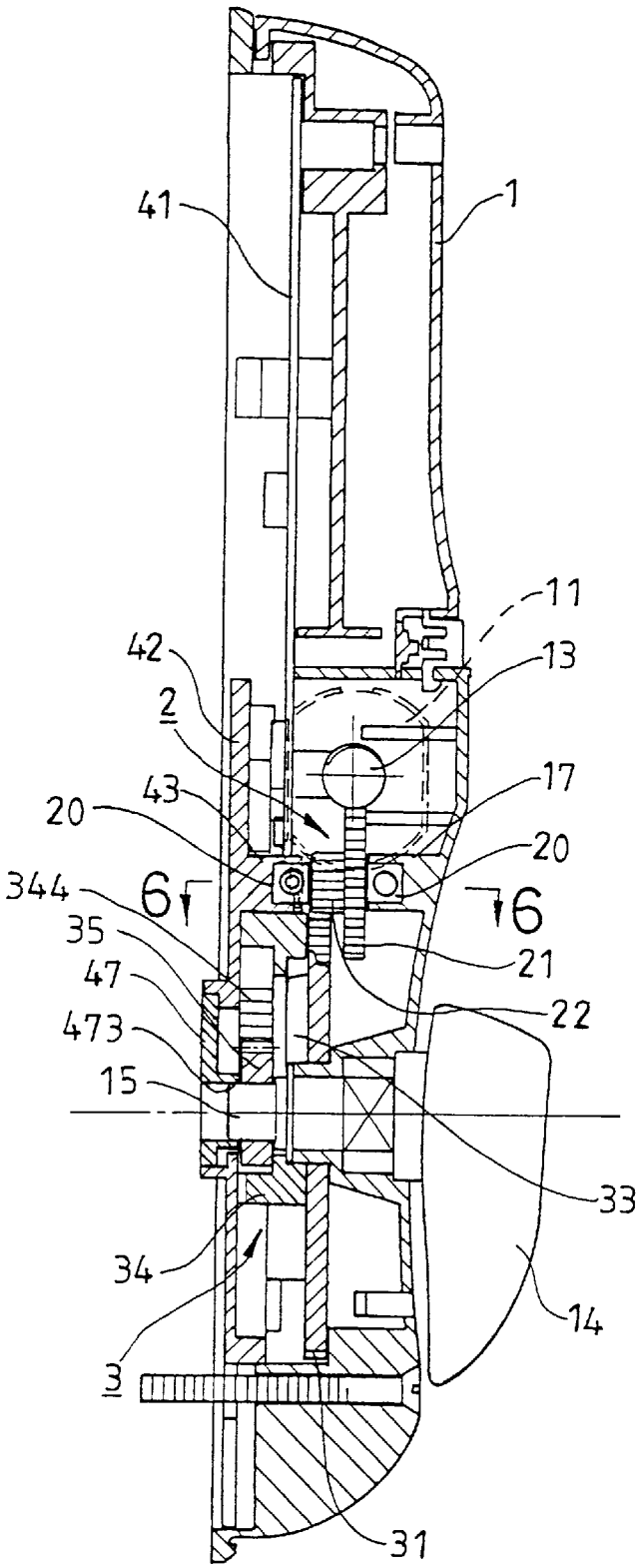
FIG. 5 is a sectional view taken along line 5—5 in FIG. 2.
Figure 7:
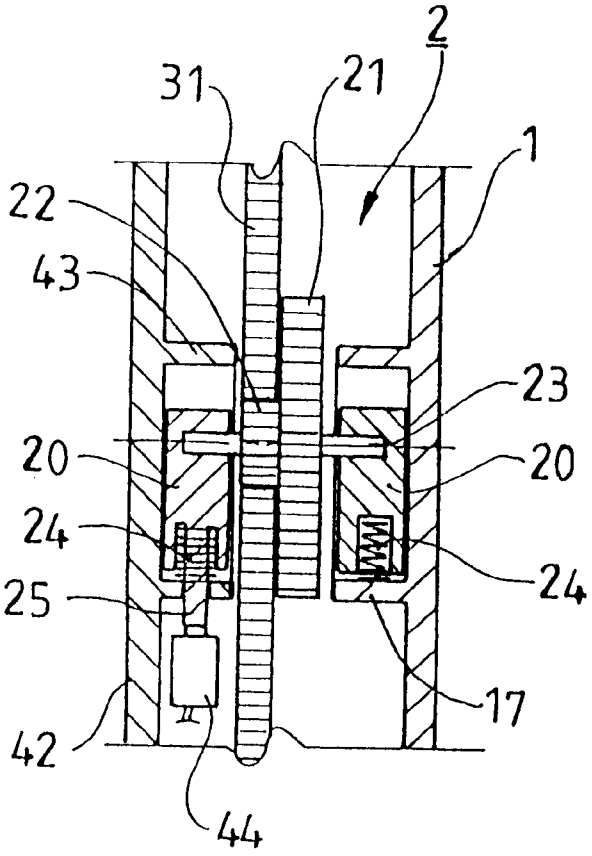
FIG. 7 is a view similar to FIG. 6, illustrating operation of the remotely controllable lock in accordance with the present invention.
Figure 6:
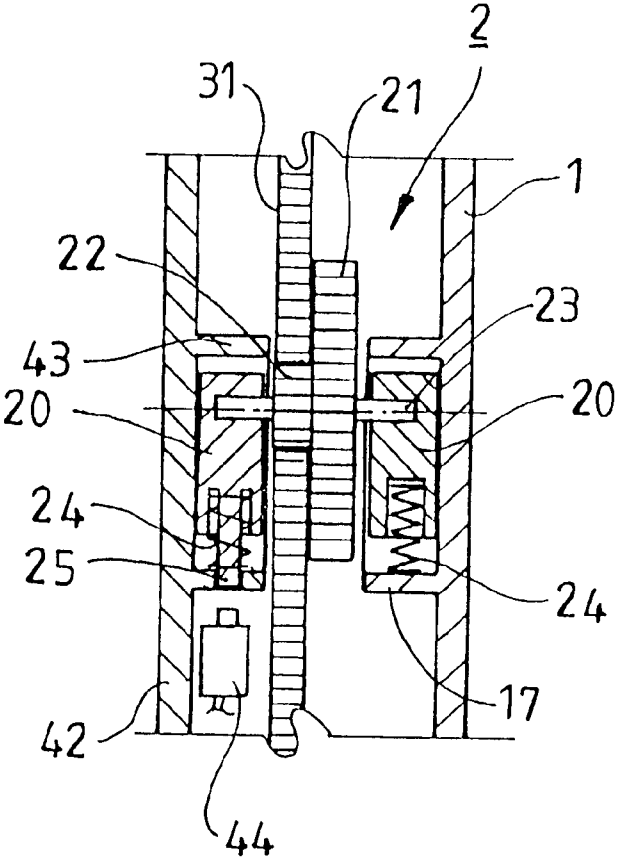
FIG. 6 is a sectional view taken along line 6—6 in FIG. 5.

Referring to FIGS. 1, 5, and 6, the power device 2 includes two slide blocks 20 that are respectively mounted in a receiving hole 17 in the housing 1 and a receiving hole 43 in a lower fixing plate 42 of the fixing device 4. The power device 2 includes a relatively larger gear 21 and a relatively smaller gear 22 that are integral with each other. The relatively larger gear 21 meshes with a transmission element 13 of the power device 11 and the relatively smaller gear 22 meshes with a control gear 31 of the control device 3. The relatively larger gear 21 and the relatively smaller gear 22 are extended through by a common shaft 23 that has two ends pivotally connected to the slide blocks 20, respectively. Each slide block 20 is biased by an elastic element 24 to urge the relatively smaller gear 22 to engage with the control gear 31 of the control device 3 (see FIGS. 2 and 6). When the control gear 31 is restrained and thus cannot be rotated, rotational force from the transmission element 13 moves the shaft 23 rightward (as viewed from FIG. 2), which, in turn, moves the two slide blocks 20 to compress the elastic elements 24. As a result, the relatively smaller gear 22 is moved outward and thus disengages from the control gear 31. In addition, a stub 25 of one of the slide blocks 20 extends beyond the receiving hole 43 (FIG. 7) to press against a sensor 44 fixed on the upper fixing plate 41. The sensor 44 sends out a signal to stop the power element 11.

Referring to FIGS. 1 and 2, the control gear 31 of the control device 3 is rotatably mounted to the axle rod 15 which, in turn, is mounted to the main housing 1. The control gear 31 and the axle rod 15 are not connected directly. The control gear 31 meshes with the relatively smaller gear 22 so as to be driven by the power element 11. The control gear 31 includes a positioning block 32 for contacting with a sensor 45 mounted on the upper fixing plate 41 such that a signal is sent out by the sensor 45 to stop the power element 11. The control gear 31 further includes an actuating block 33 on a side thereof. When the control gear 31 rotates, the actuating block 33 presses against an upper pressing block 341 or a lower pressing block 342 of a movable plate 34 to thereby move the movable plate 34 upward or downward.

Figure 8:
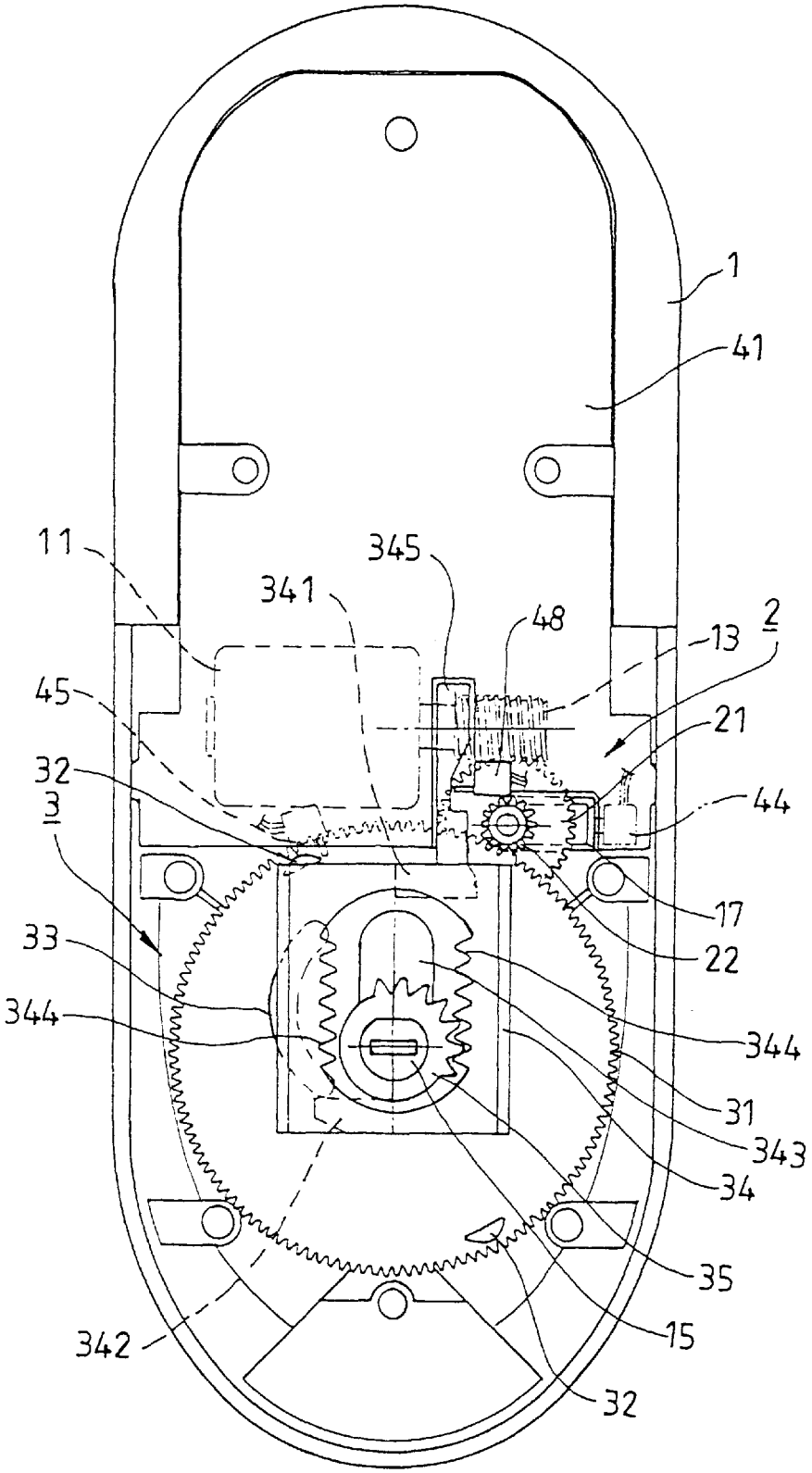
FIG. 8 is a side view illustrating a different assembly of the remotely controllable lock in accordance with the present invention.

The movable plate 34 includes a vertical slot 343 so as to move vertically along the axle rod 15. Each of two sides defining the vertical slot 343 includes a rack 344 for selectively engaging with a sector-toothed gear 35 in response to a right-handed door or a left-handed door (cf. FIGS. 2 and 8). The movable plate 34 includes a press rod 345 having an inclined slot (not labeled). When the movable plate 34 is moved upward or downward, a wall defining the inclined slot of the press rod 345 comes in contact with or disengages from a switch 48 mounted on the upper fixing plate 41. Thus, the switch 48 sends out a signal to ignore an control signal for locking (unlocking) from a remote control in a case that the movable plate 34 has been moved downward (upward) to bring the lock to a locked (unlocked) position via transmission by the sector-toothed gear 35. The sector-toothed gear 35 is mounted around the axle rod 15 in a non-circular engaging relationship. Thus, when the turn knob 14 is turned, in addition to movement of the dead bolt of the lock, the sector-toothed gear 35 moves the movable plate 34 upward or downward. Furthermore, vertical movement of the movable plate 34 causes rotational movement of the turn knob 14 via transmission by the sector-toothed gear 35 as well as retraction/extension of the dead bolt.

Referring to FIGS. 1, 2, and 5, the upper fixing plate 41 and the lower fixing plate 42 of the fixing device 4 are mounted to the main housing 1 by fasteners (such as screws). The sensors 44 and 45 and the switch 48 are mounted on the upper fixing plate 41. The receiving hole 43 of the lower fixing plate 42 receives one of the slide blocks 20 located on one side of power device 2. In response to the need of a right-handed door or a left-handed door, the sector-toothed gear 35 is selectively engaged with one of the racks 344. The lower fixing plate 42 includes an opening 46 that is greater than the sector-toothed gear 35 to allow easy access to the sector-toothed gear 35. The opening 46 may be covered by a lid 47 that includes an engaging piece 471 on an end thereof for engaging with an engaging hole 461 formed on a side of the opening 46. The lid 47 further includes an elastic hook 472 for engaging with a catch 462 on the other side of the through-hole 46. Thus, the lid 47 can be opened easily to expose the opening 46 for easy replacement of the sector-toothed gear 35 and for easy engagement of the sector-toothed gear 35 with either the left rack 344 (FIG. 2) or the right rack 344 (FIG. 8) in response to the need of a right-handed door or a left-handed door. The lid 47 further includes an axle hole 473 for rotatably supporting the axle rod 15.

Figure 3:
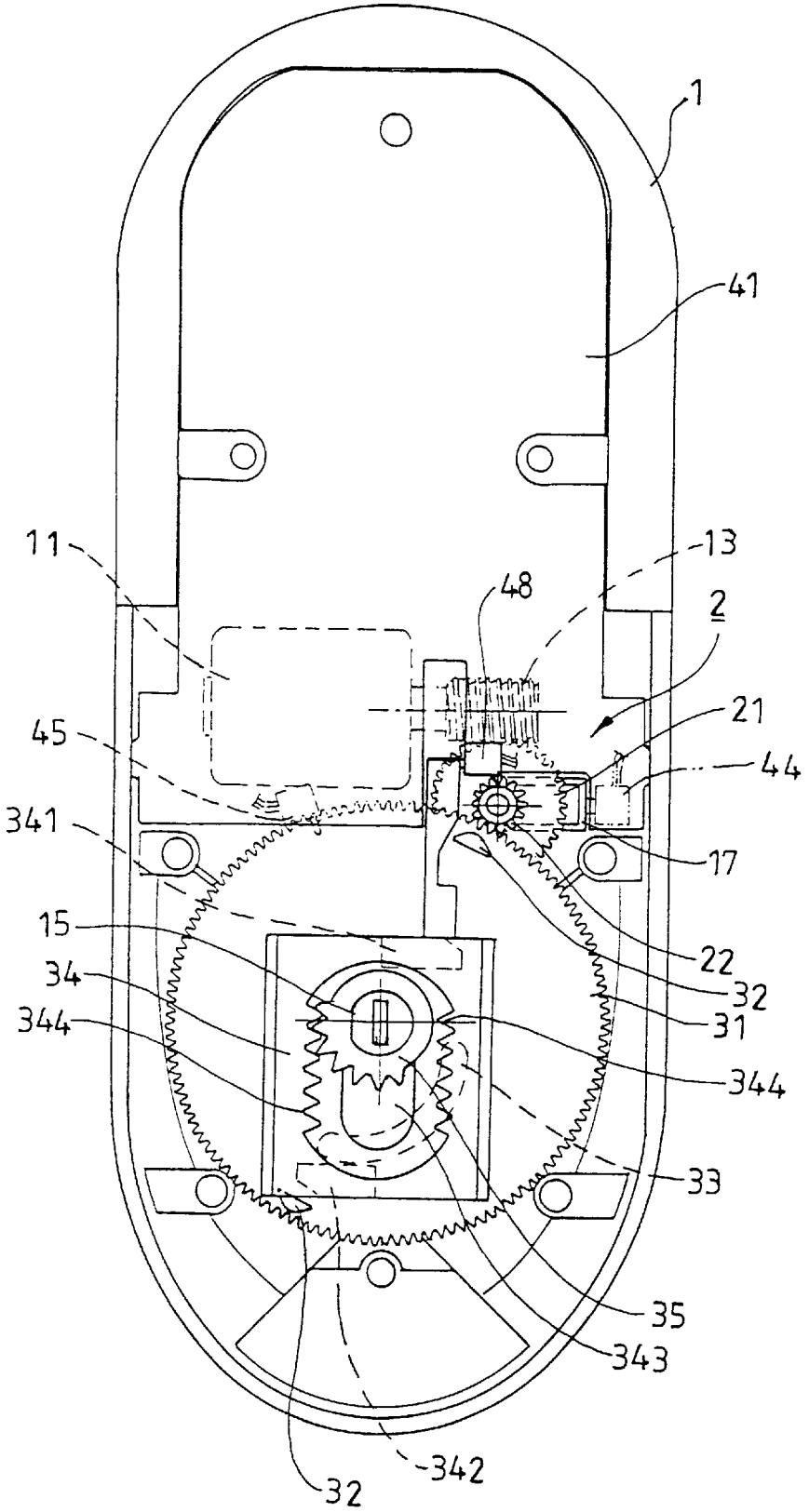
FIG. 3 is a view similar to FIG. 2, illustrating operation of the remotely controllable lock in accordance with the present invention.
Figure 4:
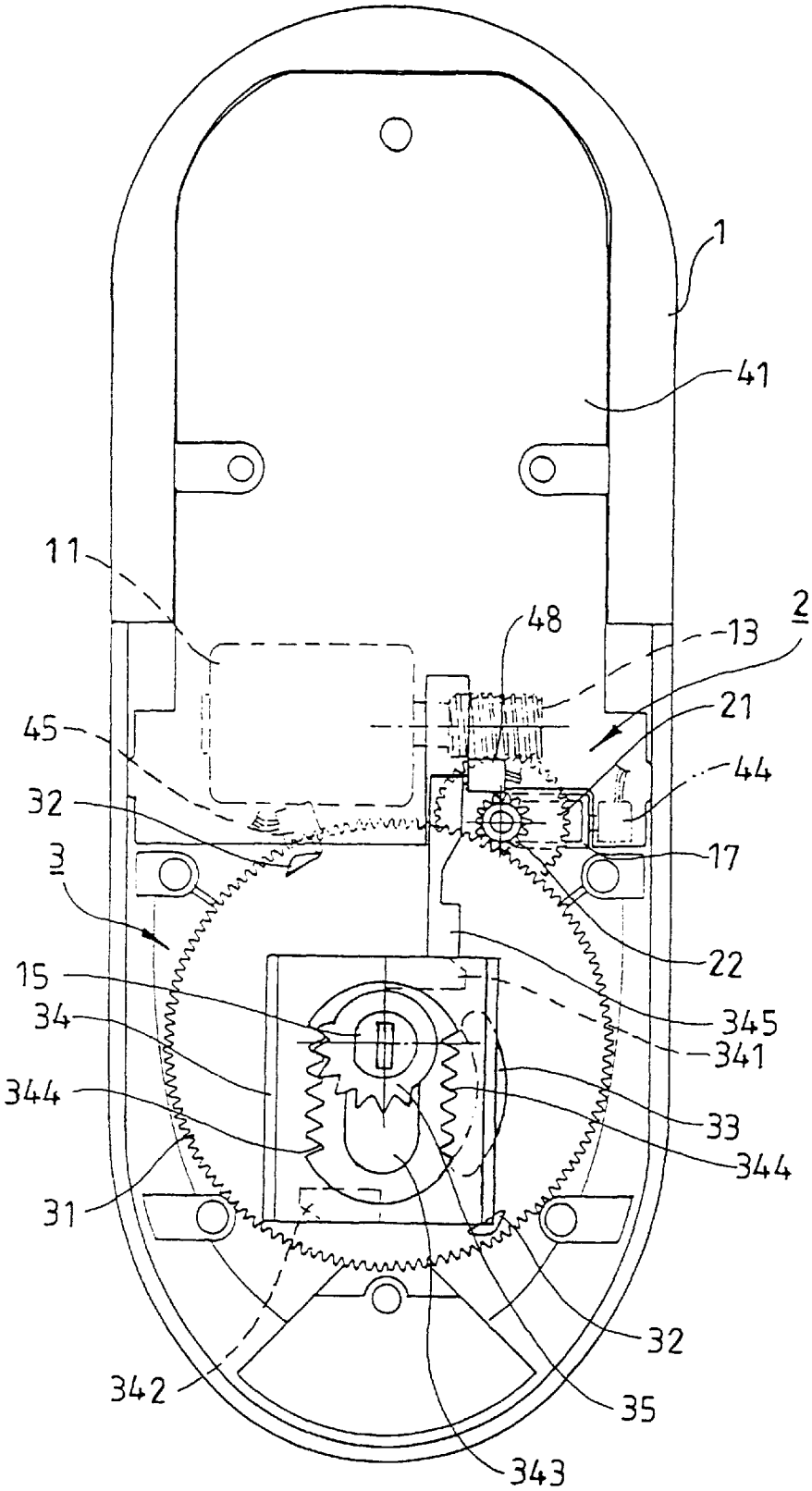
FIG. 4 is a s view similar to FIG. 2, illustrating operation of the remotely controllable lock in accordance with the present invention.

Referring to FIGS. 2 and 3, in assembly, the transmission element 13 of the power element 11 meshes with the relatively larger gear 21 of the power device 2. The relatively smaller gear 22 of the power device 2 meshes with the control gear 31 of the control device 3. The sector-toothed gear 35 meshes with one of the racks 344 located on a side (the left side in FIG. 2) of the movable plate 34. The spindle of the lock extends through the non-circular hole of the axle rod 15. Assume the lock is in an unlocked status, operation description of the lock follows.

Manual Locking/Unlocking

Referring to FIGS. 2, 3, and 5, when the turn knob 14 is turned, the axle rod 15 of the turn knob 14 turns the sector-toothed gear 35 directly. The control gear 31 does not turn since there is no connection between the control gear 31 and the axle rod 15. The spindle extended through the non-circular hole of the axle rod 15 make the dead bolt extend for locking (or retract for unlocking). At this time, the sector-toothed gear 35 moves the movable plate 34 downward. The press rod 345 of the movable plate 34 comes in contact with the switch 48. Thus, only an opposite signal for unlocking (or locking) from the remote control can be executed when the lock is in the locked status (or unlocked status). In addition, when the lock is in the locked status (or unlocked status), turning the turn knob 14 in the reverse direction may directly drive the spindle to retract (or extend) the dead bolt for unlocking (or locking).

Locking/Unlocking by Remote Control

Referring to FIGS. 2 and 3, when the remote control sends out a locking signal (or unlocking signal), the power element 11 drives the control gear 31 via transmission of the transmission element 13 and the gears 21 and 22. The control gear 31 rotates in a certain direction, e.g., counterclockwise as viewed from FIG. 2. The eccentric actuating block 33 presses against the lower pressing block 342 (or the upper pressing blocking 341) of the movable plate 34 to thereby move the movable plate 34 downward (or upward). The movable plate 34 turns the sector-toothed gear 35 which is in non-circular engaging relationship with the axle rod 15. As a result, the spindle extended through the non-circular hole of the axle rod 15 extends (or retracts) the dead bolt. At this time, the press rod 345 of the movable plate 34 comes in contact with (or not comes in contact with) the switch 48 such that the repeated locking signal (or unlocking signal) from the remote control will be ignored. In addition, as the axle rod 15 is turned, the turn knob 14 is turned to the locking position (or unlocking position). Thus, in addition to an unlocking signal (or locking signal) from the remote control, the lock can be directly unlocked (or locked) by means of directly turning the turn knob 14. Further, as the movable plate 34 has been lifted such that the press rod 345 no longer presses against the switch 48, only a locking signal from the remote control can be executed, as the unlocking signal from the remote control is invalid when the lock is in the unlocked status.

Effect

The remotely controllable lock in accordance with the present invention allows dual mode operations. In use, when the control gear 31 is restrained by an external force or fails to rotate normally, the relatively gear 22 can be disengaged from the control gear 31. In addition, one of the slide blocks 20 of the power device 2 may come in contact with the sensor 44 to send out a signal for stopping the power element 11. Thus, damage to the lock resulting from continuous rotation of the power element 11 is avoided. Further, in response to the need of a right-handed door or a left-handed door, the lid 47 can be opened easily to allow the sector-toothed gear 35 to be selectively engaged with the required racks 344 on the movable plate 34.

Although the invention has been explained in relation to its preferred embodiment as mentioned above, it is to be understood that many other possible modifications and variations can be made without departing from the scope of the invention. It is, therefore, contemplated that the appended claims will cover such modifications and variations that fall within the true scope of the invention.

What is claimed is:

1. A remotely controllable lock comprising:

a main housing comprising a power element mounted therein, the power element being operably controlled via a wire control unit, the power element including a transmission element for outputting power, the main housing further including a turn knob rotatably mounted thereto, the turn knob comprising an axle rod with a non-circular hole through which a spindle of the remotely controllable lock extends, the main housing including a first receiving hole, the axle rod further including a non-circular portion on an outer periphery thereof;

a power device comprising two slide blocks, a shaft including two ends pivotally connected to the slide blocks, respectively, the shaft further including a relatively larger gear and a relatively smaller gear mounted thereon, the relatively larger gear meshing with the transmission element;

a control device comprising a control gear that is rotatably mounted to the axle rod of the turnknob, the control gear meshing with the relatively smaller gear of the power device, the control gear comprising a positioning block and an eccentric actuating block, the control device further including a movable plate comprising an upper pressing block, a lower pressing block and a vertical slot, the axle rod is received at the vertical slot, thereby allowing the movable plate to be movable along a vertical axis of the axle rod, the movable plate including a rack, a sector-toothed gear being mounted around the non-circular portion of the axle rod to rotate therewith, the sector-toothed gear meshing with the rack the movable plate further including a pressing rod that is capable of coming in contact with a switch; and a fixing plate secured to the main housing and comprising a second receiving hole, one of the slide blocks being received in the first receiving hole of the main housing and the other of the slide blocks being received in the second receiving hole of the fixing plate, each said slide block being biased by an elastic element, one of the slide blocks including a stub extended beyond an associated one of the first receiving hole and the second receiving hole, the stub being capable of coming in contact with a first sensor to send out a signal for stopping the power element, the fixing plate further including an axle hole for rotatably supporting the axle rod and through which the spindle extends for driving a dead bolt of the remotely controllable lock, whereby when the control gear rotates, the eccentric actuating block comes in contact with one of the upper pressing block and the lower pressing block of the movable plate so as to make the positioning block come in contact with a second sensor to send out a signal for stopping the power element.

2. The remotely controllable lock as claimed in claim 1, wherein the main housing includes an elastic member for clamping the non-circular portion of the axle rod to thereby retain the turn knob in predetermined positions after rotation.

3. The remotely controllable lock as claimed in claim 1, wherein one of the slide blocks of the power device is biased by an associated said elastic element for urging the relatively smaller gear to mesh with the control gear.

4. The remotely controllable lock as claimed in claim 1, wherein the movable plate comprises a second rack, the first-mentioned rack and the second rack being respectively mounted to two sides of the vertical slot for selective engagement with the sector-toothed gear.

5. The remotely controllable lock as claimed in claim 1, wherein the first sensor, the second sensor, and the switch are mounted to the fixing plate.

6. The remotely controllable lock as claimed in claim 1, wherein fixing plate comprises an upper fixing plate and a lower fixing plate, the first sensor, the second sensor, and the switch being mounted to the upper fixing plate, the second receiving hole being defined in the lower fixing plate for receiving an associated one of the slide blocks.

7. The remotely controllable lock as claimed in claim 1, wherein the fixing plate includes an opening aligned with the axle rod, the sector-toothed gear being accessible via the opening, further comprising a lid for closing the opening.

8. The remotely controllable lock as claimed in claim 6, wherein the fixing plate includes an opening aligned with the axle rod, the sector-toothed gear being accessible via the opening, further comprising a lid for closing the opening.

* * * * *